US005472263A

United States Patent [19]

Gerspacher

[11] Patent Number: 5,472,263

[45] Date of Patent: Dec. 5, 1995

[54] APPARATUS FOR PROFILING BRISTLE FIELDS

[75] Inventor: Helmut Gerspacher, Freiburg, Germany

[73] Assignee: Firma Anton Zahoransky, Todtnau, Germany

[21] Appl. No.: 207,431

[22] Filed: Mar. 7, 1994

[30] Foreign Application Priority Data

Sep. 6, 1993 [DE] Germany ..... 43 30 029.4

[51] Int. Cl.[6] ..... A46D 9/02

[52] U.S. Cl. ..... 300/17; 300/2

[58] Field of Search ..... 300/2, 17

[56] References Cited

U.S. PATENT DOCUMENTS

| | | | |
|---|---|---|---|
| 359,847 | 3/1887 | Coldwell | 300/17 |
| 1,495,747 | 5/1924 | Izawa | 300/17 X |
| 1,873,660 | 8/1932 | Neely | 300/17 |
| 2,669,075 | 2/1954 | Dreyfus | 300/17 X |
| 3,194,604 | 7/1965 | Lambert | 300/17 |

FOREIGN PATENT DOCUMENTS

| | | |
|---|---|---|
| 0078569 | 5/1983 | European Pat. Off. . |
| 4138777 | 5/1993 | Germany . |

*Primary Examiner*—Timothy V. Eley
*Attorney, Agent, or Firm*—Panitch Schwarze Jacobs & Nadel

[57] ABSTRACT

A process and apparatus are provided for executing profiling trimming cuts in the bristle fields of toothbrushes. In order to process the fibers separately in different regions of the bristle field, and particularly to shorten them by means of a straight cutter or a level grinding disk, the fibers in the bristle field regions that are not to be contacted by the processing tool, are held at a distance from the processing plane of a processing tool by means of a lateral deflection of the free fiber ends in the longitudinal direction of the respective bristle field region. If the process is employed in several steps, in which respective fibers from various bristle field regions are to be processed, almost any desired profile cross-section can be created in the bristle field, not only in the longitudinal direction but in the transverse direction as well. Processing at each processing stage can thereby be accomplished with straight processing tools, for example with straight cutters. It is thus possible to dispense with the use of expensive profile cutters.

8 Claims, 5 Drawing Sheets

1
2
10
20
21
22
23
24
30
31
32
33
A
40
41
42
43
50
51
52
53
3

1
2
10
50
52'
51'
40
42'
41'
43
53
30
32'
31'
20
22'
21'
23
33

APPARATUS FOR PROFILING BRISTLE FIELDS

FIELD OF THE INVENTION

The invention relates to a process for executing profiling trimming cuts in the bristle fields of brushes, as well as an apparatus for carrying out this process.

BACKGROUND OF THE INVENTION

With present day toothbrushes, it is preferable if the cleaning surface is given a serrated profile; the bristles of the toothbrush can then penetrate better into the spaces between the teeth. The profiling of the bristle fields is usually carried out by means of a profile cutter, the contour of which is matched to the desired bristle field contour. If, for example, a serrated profile with a profile angle of 45° is to be produced, a profile cutter can be used whose cutting edges are angled at 45° to match the contour that is to be placed on the bristle field. This has the consequence, however, that the individual fibers of the bristle field are no longer trimmed off straight across, but are instead trimmed off pointed at a 45° angle. So that the bristles do not injure the sensitive gum tissue, the pointed fiber ends must be rounded off by means of a time-consuming and sometimes machine-intensive procedure.

Stepped cutters are also already known (see German Offenlegungsschrift DE-41 38 777), by means of which the saw-toothed profile can be approximated through the use of a finely graduated stepped profile; in this way, the majority of the fibers are cut off evenly. Although this procedure and the associated apparatus offer quite a number of advantages, they also display some disadvantages. For example, it is usually impossible to prevent some of the fibers from lying in the border area that runs vertically between two steps, and thus being cut off uncleanly at the ends or even frayed. In addition, the stepped cutters are difficult and expensive to manufacture, and can be resharpened only with difficulty.

There is also an apparatus that is already known (see EP 0 078 569 A2), by means of which the fibers at the edge of a bristle field are laterally deflected towards the outside by bringing a wedge-shaped tool into the bristle field. The inner fibers, which are not deflected, can then be processed, that is for example cut off or rounded, without the processing tool coming into contact with the outer fibers. The apparatus is suitable for providing bristle fields with simple profiles, preferably those in which the fibers at the edges of the bristle field have greater lengths than the fibers in the middle of the bristle field. However, more complex profiles, especially those in which the profile running in the longitudinal direction of the brush repeats itself regularly several times, cannot in practice be manufactured, since in this case the fibers in the middle of the bristle field as well must be processed differently. This is hardly possible with the apparatus described above, since the fibers to be deflected then collide with the neighboring fibers to be processed.

A further disadvantage of the latter apparatus is that it only allows for a discontinuous mode of operation. Specifically, the processing stations are placed at regular intervals on a common carriage that is moved relative to the toothbrushes during the processing cycle. At the end of the processing cycle, the work procedure must be interrupted so that the carriage can be returned to its starting position.

SUMMARY OF THE INVENTION

Therefore, the particular object of the invention is to develop a process of the type mentioned above whereby the profiling trimming cuts can be executed, especially in the transverse direction of the bristle fields, in such a way that all of the fiber ends are flawlessly processed at an angle that is as blunt as possible so that they can be rounded off in a simple way. In addition, it is also an object to design an apparatus for carrying out this process.

According to the means of the present invention, the fibers are basically deflected in the longitudinal direction of the fiber area that is to be deflected. It is therefore possible to deflect even bristle field segments in the central area of the bristle field, without the deflected fibers colliding with the neighboring fibers that are to be processed. If the procedure is carried out in several steps, and if in each step only the fibers in a specific section of the bristle field are processed while the remaining fibers are deflected at that time, a profile can be effected in the bristle field in a simple way.

If fibers in one section of the bristle field are to be processed by various tools or different tools, it is advantageous to maintain or effect the deflection of the fibers between the individual processing procedures as well, such as, for example, during the transport of the toothbrushes from one processing station to the next. This ensures that the processing tools in question engage exactly the same fibers. In this way it is possible to exclude to the greatest extent possible errors that occur due to fibers lying at the edges of a deflected area being deflected a second time upon renewed deflection, and thus not being engaged by the following processing procedure.

For this reason it is especially advantageous during a deflection procedure to first shorten the non-deflected fibers to the required length and then to round off their free ends. In an especially economical and rapid variation of the procedure, a cutter is used for the shortening of the fibers by means of which it is possible to cut off the entire bristle field at the location in question in just a single, large-surface operation. When this is done, it is possible to work with uniform standard cutters such as for example, disk cutters or straight cylindrical cutters, independent of the geometry of the profile. It is thus possible to dispense with the purchasing of expensive step cutters or profile cutters.

In a further processing step, the fibers that have been shortened by the cutter can be rounded off at their free ends by means of a grinding disk. If a powerful disk grinder is used, the shortening of the fibers can also be carried out by means of the disk grinder.

This results in an especially simple design of the processing installation, since only one processing station is necessary for profiling and rounding off the fibers. In this case, it is advantageous to place the disk grinder at somewhat of an angle with respect to the brush surface that is to be processed, so that when the bristle field is brought into the processing area of the disk grinder, the distance between the processing area and the brush body decreases in a continuous fashion. In this way it is possible to achieve an even grinding off of the fibers without the danger that the fibers will deflect to the side and thus be ground off at an angle at their ends.

One expedient embodiment of an apparatus for executing profiling trimming cuts on bristle fields has pushing elements that act upon the free ends of the fibers and in essence deflect them laterally and somewhat downwardly (i.e., toward the brush body). In order to make it possible to bring the pushing element into the bristle field, the brush and the pushing element are movable relative to one another. A preferred embodiment of the pushing element covers, towards the top (i.e., toward the fiber ends), the bristle field area to be deflected, and has in addition, lateral guides that prevent a lateral deflection of the fibers out of the bristle field area to be deflected and in the direction of the fibers to be processed. The advantage of the covering is that bristle field areas of any desired size can be deflected.

A particular embodiment of the invention has several processing stations, for example, a cutting station for shortening the fibers and a grinding station for rounding the fibers, which have at least one common, continuous lateral guide for the fibers to be deflected. The brush is thereby guided in such a way that the lateral guide remains in constant contact with the bristle field both within the processing station and between processing stations. This ensures that exactly the same fibers are processed in both of the processing stations. In comparison with processing stations with separate pushing elements, in which the pushing elements must be arranged with exactness relative to each other and also with respect to a stepped cutter that may be present, there is less need for adjustment as well.

In one advantageous embodiment, several pushing elements or lateral guides, the number of which preferably corresponds to the number of profiling trimming cuts to be carried out, are fixedly connected with one another into a single unit. In particular, this results in a stable design that requires little adjusting. If identical pushing elements are connected together into a symmetrically designed unit, bristle fields with a cyclically repeating profile can be made in a simple manner. In this case the work sequences are the same in all of the profiling trimming cuts, and can be carried out in parallel in a single working pass.

An especially favorable embodiment of the invention consists in placing the pushing elements in a fixed location relative to the processing station and moving the brushes relative to these. The transport movement of the brush is then used, on the one hand, for moving the bristle field against the pushing elements and thus deflecting the fibers, and on the other, for implementing the working feed when the processing tool is reached. In this way, a completely even, continuous material flow is achieved, in which the processing tools can be used in a nearly uninterrupted manner.

In a further embodiment of the invention the orientation of the brush can be changed relative to the pushing elements. By this means, the bristle field can be profiled in different directions, for example in the longitudinal and transverse directions, with relatively little effort. If the orientation of the brush is not to be changed, profiles that run in different directions can also be created by having additional pushing elements present, which are movable with respect to the brush and which can be moved into the bristle field in the direction of the respective profile.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. For example, each of the individual features can be utilized by itself or several at a time can be utilized in a single embodiment of the invention. The following are shown in differing scales and sometimes more heavily schematicized. In the drawings.

DETAILED DESCRIPTION OF THE PREFERRED EMBODIMENTS

Figures 1, 2, 3, 4, 5, 6:
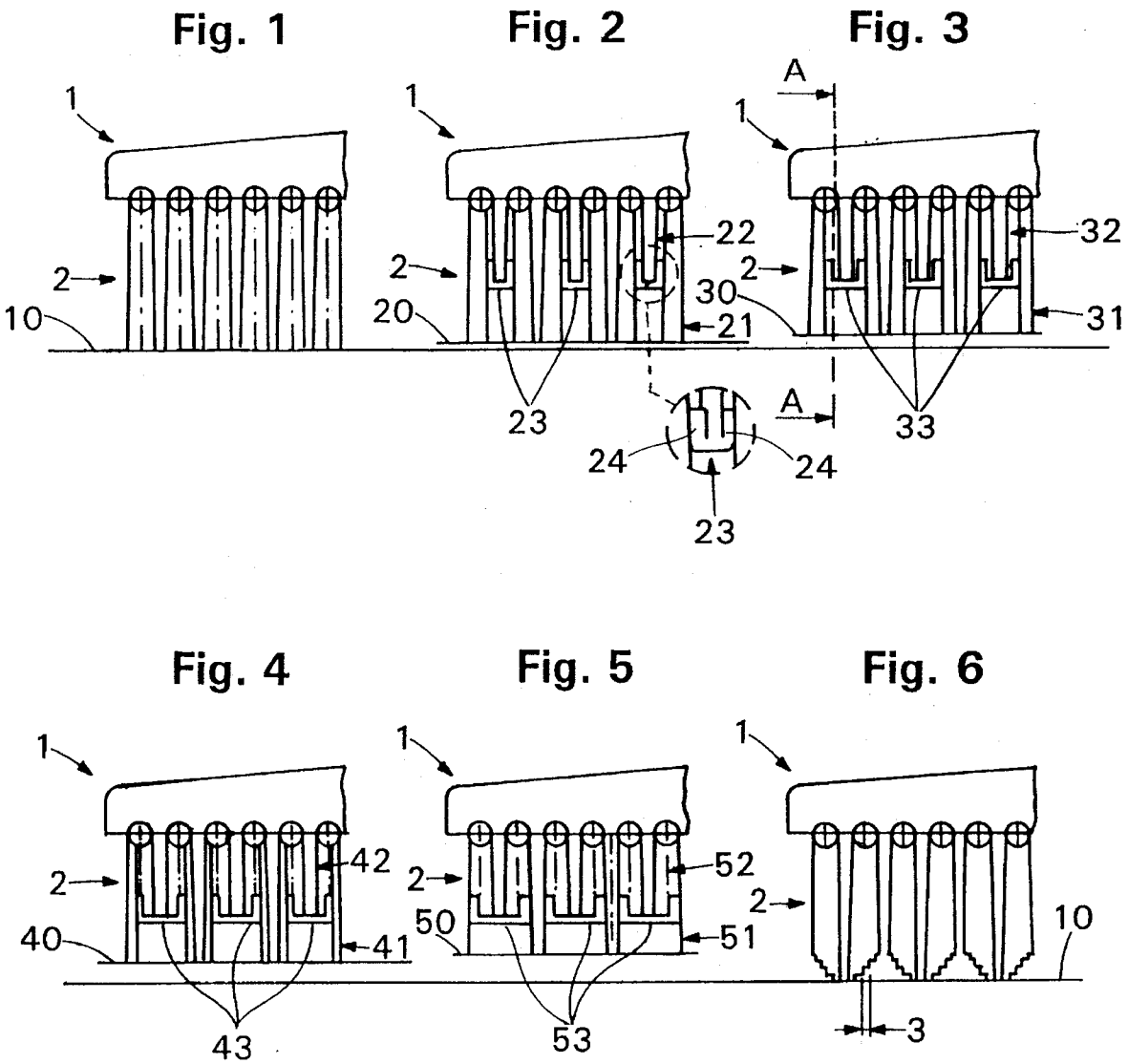
FIG. 1 is a partial side view of a brush head with an evenly cut bristle field in which the ends of the fibers lie in one plane.
FIGS. 2 through 5 are partial views of the brush head, shown in FIG. 1, in which the longer fibers to be processed are deflected away from the shorter fibers by means of pushing elements perpendicular to the plane of the drawing.
FIG. 6 is a partial view of a brush head with a bristle field that has been fully profiled in the transverse direction; the bristle field having an approximately symmetrical saw-toothed profile by virtue of steps.
Figure 19:
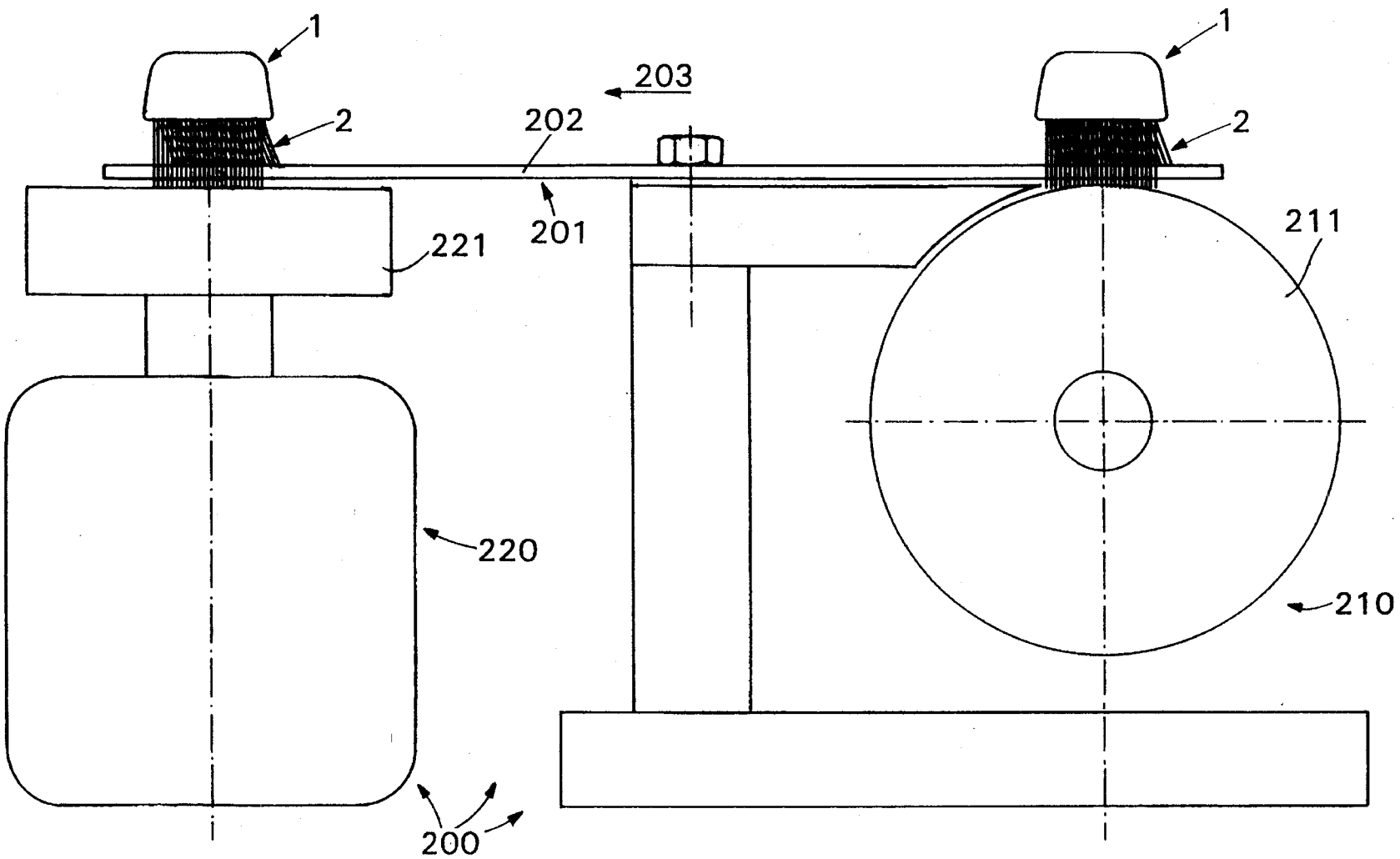
FIG. 19 is a simplified side view of a processing machine for profiling of toothbrushes, which has one cutting station and one grinding station which have common pushing elements for deflecting the fibers.
Figure 20:
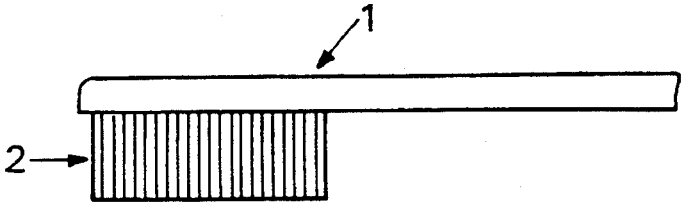
FIG. 20 is a side view of a toothbrush with a level bristle field.
Figure 21:
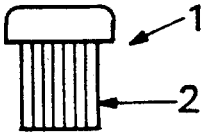
FIG. 21 is a front view of a toothbrush with a level bristle field.
Figure 22:
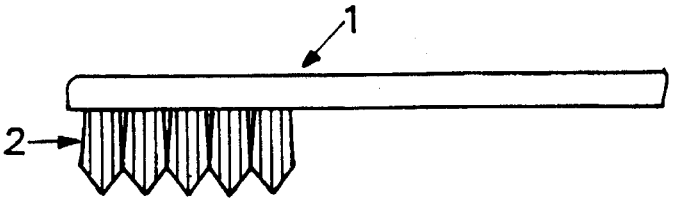
FIG. 22 is a side view of a toothbrush with a bristle field that has been profiled in the transverse direction with a saw-tooth or serrated cut.
Figure 23:
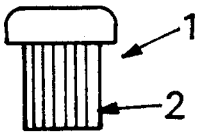
FIG. 23 is a front view of a toothbrush with a bristle field that has been profiled in the transverse direction with a saw-tooth or serrated cut.

FIGS. 1 through 6 show the operational sequence for profiling the bristle field 2 of a partially represented toothbrush 1, whereby the completely processed bristle field has a cyclically repeating, symmetrical bristle profile that runs in a direction that is transverse to the toothbrush 1. (see FIGS. 22, 23). First of all, the bristle field 2 is cut off even, at its highest at level 10, preferably by means of a straight cutter 211 (FIGS. 1, 19). Next, all of the fibers 22, which are to form the highest level of the finished bristle profile, are deflected in a direction that is perpendicular to the plane of the drawing. To do this, several pushing elements 23, which are U-shaped in cross-section and which run perpendicular to the plane of the drawing, act upon the toothbrush 1. Because of the special form of the pushing elements 23, the fibers 22 are guided into channels (formed between lateral guides or uprights 24), so that during the course of the deflection they cannot stray sideways in the direction of the neighboring fibers 21 that are to be processed. The non-deflected fibers 21 are now cut once again at the height of the second-highest profile level 20. To do this, a straight cutter 211 (FIG. 19) is used that is much simpler to handle than a profiled cutter, has a longer tool life, and is substantially more cost-effective. In addition, the use of the straight cutter 211 ensures that all of the fiber ends are cut off exactly at a right angle.

Figures 26, 27:
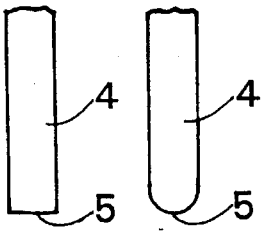
FIG. 26 is a side view of the free end of a fiber that has been cut off bluntly by means of a straight cutter.
FIG. 27 is a side view of the free end of a fiber that has been cut off at an angle of 45° by means of a profile cutter.
Figure 30:
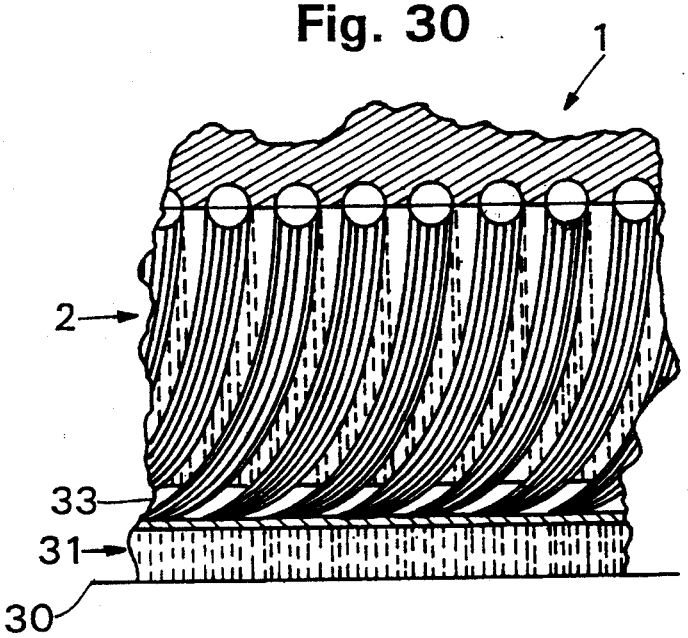
FIG. 30 is a partial section in the plane A—A through the toothbrush shown in FIG. 3.

Following that, wider pushing elements 33 are brought into the bristle field, by means of which the fibers 32 of the two highest profile levels are deflected (FIG. 3). FIG. 30 shows a section in the plane A—A through the toothbrush 1, in which the direction of deflection of the fibers 32 can be seen. For the sake of clarity, the rear fibers 31 that have not been deflected are shown in FIG. 30 as dashed lines. Once the fibers 32 have been deflected by means of the pushing elements 33, the remaining fibers 31 are cut off at the height of the third-highest profile level 30 by means of a straight cutter 211. The fourth-highest profile level 40 and the fifth-highest profile level 50 are then created in the bristle field 2 in the same way, whereby the width of the respective pushing elements 43, 53 is selected to match the desired profiling cross-section (FIGS. 4 and 5). The completely profiled bristle field (FIG. 6) with cuts 3 then exhibits a finely stepped profile in which all of the fibers 4 have been cut off at a right angle (FIG. 26).

Figures 7, 8, 9, 10, 11, 12:
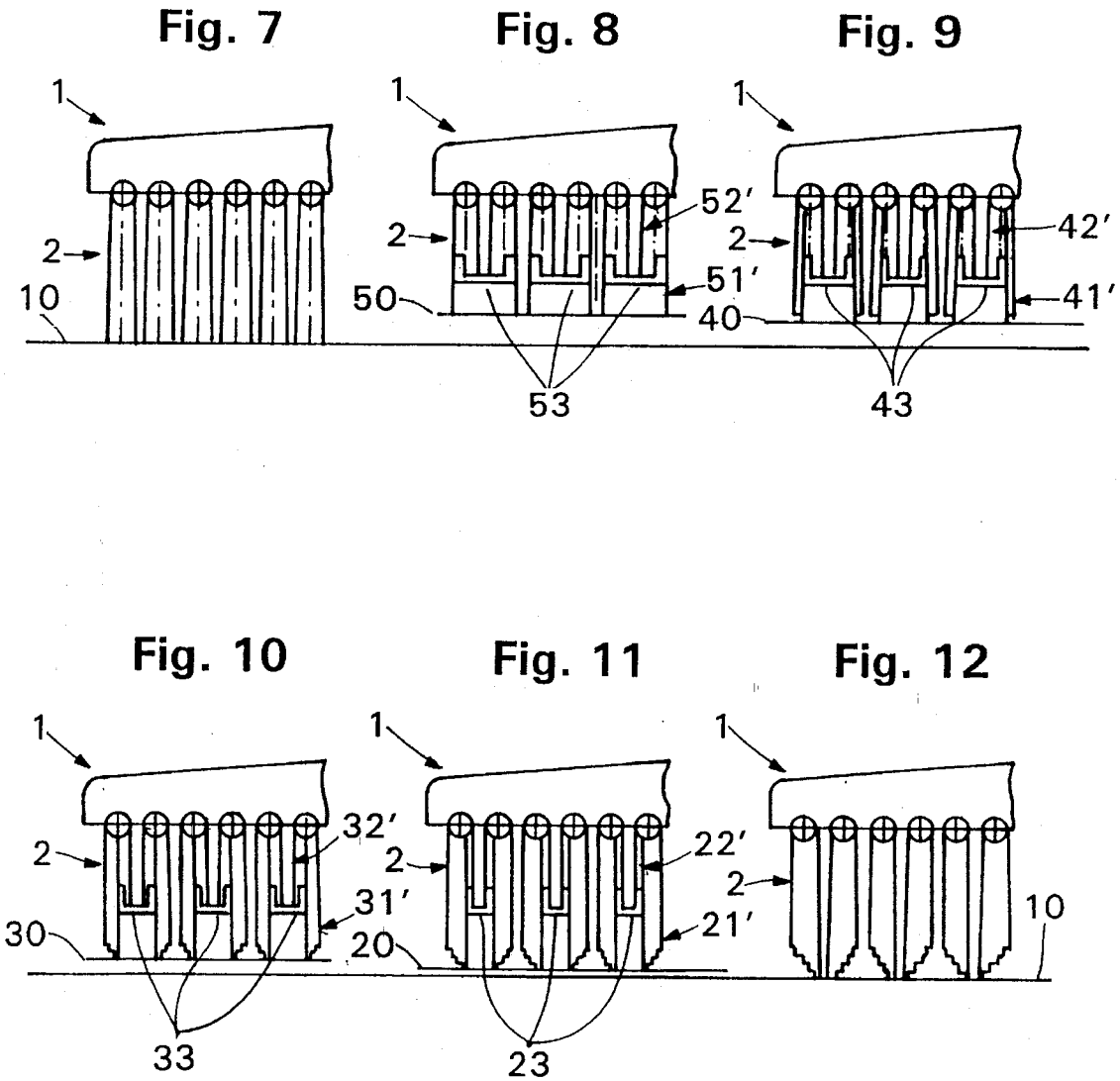
FIG. 7 is a partial view of a brush head with a straight-cut bristle field, corresponding to FIG. 1, FIGS. 8 through 11 are partial views of the brush head shown in FIG. 7, in which the longer fibers to be processed are deflected away from the shorter fibers by means of pushing elements perpendicular to the plane of the drawing.
FIG. 12 is a partial view of a brush head with a bristle field that has been fully profiled in the transverse direction, corresponding to FIG. 6.
Figure 13:
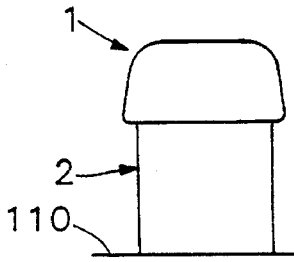
FIG. 13 is a front view of a brush head with a straight-cut bristle field in which the fiber ends lie in one plane.

In the processing sequence shown in FIGS. 1 through 6, first the longer fibers are processed and then the shorter fibers. One can proceed in the reverse way, however, which is made clear by means of FIGS. 7 through 12. When this is done, the same pushing elements 23, 33, 43, 53 are used as in FIGS. 2 through 5, but in reverse order. First, the bristle field 2 is cut off evenly at its highest level 10, preferably by means of a straight cutter 211 (FIGS. 7 and 19). Then, all of the fibers 52', which are to form the four highest levels of the finished bristle profile, are deflected in a direction perpendicular to the plane of the drawing by means of the pushing elements 53 (FIG. 8). The non-deflected fibers 51' are now cut off again at the fifth-highest profile level 50 by means of a straight cutter 211.

After that, narrower pushing elements 43, by means of which the fibers 42' of the three highest profile levels are deflected, are brought into the bristle field (FIG. 9). Then, the remaining fibers 41' are cut off at the height of the fourth-highest profile level 40 by means of a straight cutter 211. The third-highest profile level 30 and the second-highest profile level 20 are then created in the bristle field 2 in the same way, whereby the width of the respective pushing elements 33, 23 is selected to match the desired profiling cross-section (FIGS. 10 and 11). The completely profiled bristle field (FIG. 12) again exhibits a finely stepped profile in which all of the fibers 4 have been cut off at a right angle (FIG. 26).

In a preferred embodiment of the invention, the pushing elements 23, 33, 43, 53 (FIGS. 2 through 5 and 8 through 11) and the processing stations 210, 220 (FIG. 19) are arranged in a fixed position, and the toothbrush 1 is movable relative to them perpendicular to the plane of the drawing (FIGS. 2 through 5 and 8 through 11). In this way, the transport movement of the toothbrushes, which is necessary in any case, can also be used in the work steps shown in FIGS. 2 through 5 and 8 through 11 to move the respective pushing elements 23, 33, 43, 53 into the bristle field 2 as they are needed, to deflect the fibers 22, 32, 42, 52 and 22', 32', 42', 52', and to implement the working feed as well. Through these measures there results a continuous work flow and, in addition, a uniform progression for the toothbrushes 1; a reverse movement being avoided.

In an especially advantageous form of the invention after cutting, the fibers that are not deflected are rounded off at their free ends by means of a grinding disk 221 (FIG. 19) at each of the work steps shown in FIGS. 2 through 5 and 8 through 11 after the cutting. In this case, a grinding station 220 follows each cutting station 210, as is shown in FIG. 19 for one of the work steps.

Figures 28, 29:
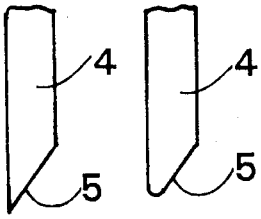
FIG. 28 is a side view of the fiber shown in FIG. 27 that has been rounded off at its free end by means of a grinding disk.
FIG. 29 is a side view of the fiber shown in FIG. 26 that has been rounded off at its free end by means of a grinding disk.

FIG. 26 Shows a side view of the free ends of the fibers after the cutting procedure in which the free fiber ends 5 are cut off bluntly. By means of the grinding process that follows, the fiber ends 5 can be rounded off completely uniformly (FIG. 29). The high manufacturing quality that can be achieved with this procedure is made clear from a comparison with FIG. 27, in which a side view is shown of a fiber 4 that has been cut off by means of a 45° profiling cutter, and that can no longer be sufficiently rounded off by the following grinding of its free end 5 (FIG. 29).

In order to ensure that exactly the same fibers are acted upon for the cutting and the grinding, the cutting station 210 and the grinding station 220 have common, continuous pushing elements 201 with lateral guides 202, with which the toothbrushes 1 are in continuous contact during the processing as well as during the transport from the cutting station 210 to the grinding station 220 (FIG. 19).

In a simplified embodiment, the pushing elements 201 are formed only in the work area of the respective processing stations 210, 220, while the lateral guides 202 of the work stations 210, 220 are connected with one another throughout. In this case, the pushing elements 201 and/or the lateral guides 202 can be connected to each other in a flexible unit that can be easily aligned with the processing stations 210, 220.

Figure 24:
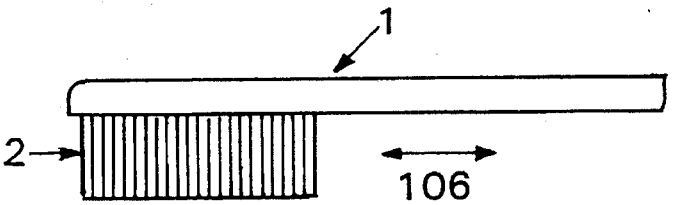
FIG. 24 is a side view of a toothbrush with a bristle field that has been profiled in the longitudinal direction.
Figure 25:
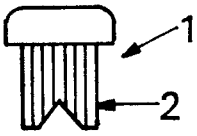
FIG. 25 is a front view of a toothbrush with a bristle field that has been profiled in the longitudinal direction.

If the toothbrushes are to be profiled in several directions, for example in the transverse direction (FIGS. 22, 23) and in the longitudinal direction (FIGS. 24, 25), pushing elements (23, 33, 43, 53 and 123', 133', 143', 153') must be available that can be brought into the bristle field in different directions, for example in a longitudinal or transverse direction, so that the fibers can be deflected in the direction required in each case. It is then expedient to orient the toothbrush 1 in such a way that one of the profiles, for example the transverse profile (FIGS. 22, 23), is aligned with its longitudinal direction in the transport direction 203 (FIG. 19) of the toothbrush 1. The pushing elements 23, 33, 43, 53 for this profile direction can then be placed at the processing stations 210, 220 in a fixed manner. The pushing elements 123', 133', 143', 153' (FIGS. 14 through 17) for the longitudinal profile (FIGS. 24, 25) can likewise still be fixed with respect to the processing station, but they must in addition have a conveying device by which they can be moved in the longitudinal direction 106 of the longitudinal profile with respect to the toothbrush 1.

Since the pushing elements 123', 133', 143', 153', unlike the pushing elements 23, 33, 43, 53 that run in the direction of transport 203, only enter the bristle field 2 at the respective processing stations 210, 220, the appropriate work tool 211, 221 must be lowered sufficiently, before the entry of the toothbrush 1 into the processing stations 210, 220, so that the bristles that have not yet been deflected do not come into contact with the processing tools 211, 221. Only after the pushing elements 123', 133', 143', 153' have entered into the bristle field 1 can the respective work tool 211, 221 be moved to the desired working height. The sequence of this procedure is shown in FIGS. 13 through 18 by means of an example of a toothbrush 1 whose bristle field 2 is being profiled in the longitudinal direction.

Figure 14:
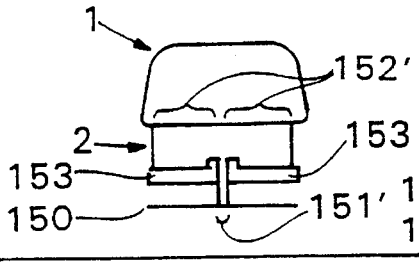
FIGS. 14 through 17 are partial views of the brush head shown in FIG. 13, in which the longer fibers to be processed are deflected away from the shorter fibers by means of pushing elements in the plane of the drawing.
Figure 15:
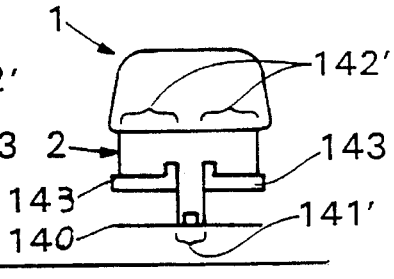

First, the bristle field 2 is cut off evenly at its highest level 110 (FIG. 13), preferably by means of a straight cutter 211 (FIG. 19). Then, all of the fibers 152', which are to form the four highest levels of the finished bristle profile, are deflected in a direction perpendicular to the plane of the drawing by means of the pushing elements 153 (FIG. 14). The cutter 211 is then raised, and the non-deflected fibers 151' are cut again at the height of the fifth-highest profile level 150. After that, the cutter 211 is again lowered to at least level 110 so that the pushing elements 153' can be withdrawn from the bristle field 2 perpendicular to the plane of the drawing, without the fibers 152' coming into contact with the cutter 211.

After that, narrower pushing elements 143' (FIG. 15) that deflect the fibers 142' of the three next-highest profile levels are moved into the bristle field. Then, the processing tool is raised to level 140, and the fibers of the fourth-highest profile level are cut. After that, the processing tool is again lowered to at least level 110 so that the fibers 142' do not come into contact with the processing tool when the pushing elements 143 are removed.

Figure 16:
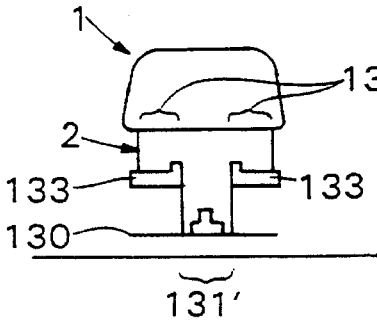
Figure 17:
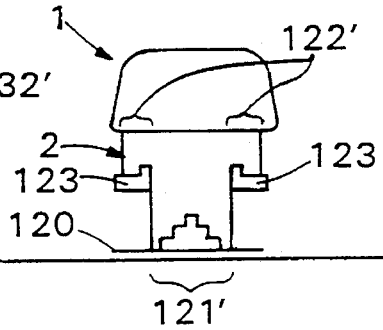
Figure 18:
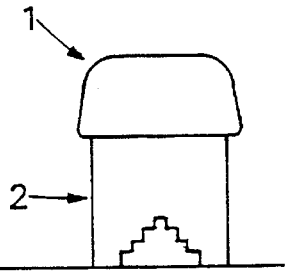
FIG. 18 is a partial view of a brush head with a bristle field that has been fully profiled in the longitudinal direction and that has an approximately triangular profile by virtue of steps.

Subsequently, the fibers of the third-highest profile level 130 and the second-highest profile level 120 are processed in the same way, whereby respective portions 132', 122' of the bristle field 2 are deflected each time (FIGS. 16, 17). The completely profiled bristle field (FIG. 18) then exhibits a finely stepped profile with fibers 4 that have been cut off at a right angle (FIG. 26).

According to one advantageous embodiment of the invention, the orientation of the toothbrush 1 with respect to the direction of transport 203 of the toothbrush 1 can be altered in such a way that the respective profile to be made has its longitudinal direction in alignment with the transport direction 203. In this way, all of the pushing elements 23, 33, 43, 53, and 123', 133', 143', 153' can be arranged in fixed positions. The above-mentioned conveying device for the pushing elements 123', 133', 143', 153' can then be dispensed with. In addition, the work tools 211, 221 do not require any adjusting movements. The rotatable tensioning device does require, however, that the toothbrush 1 be fixed in place as exactly as possible with respect to the axis of rotation so that the bristle field 2 is not laterally displaced in an unwanted manner by the rotation process.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Apparatus for executing profiling trimming cuts in a bristle field of a brush, said bristle field comprising fibers which extend in a first direction from a body of the brush and an area of the field having a longitudinal axis substantially perpendicular to the fibers, wherein fibers in a first portion of the bristle field area make contact with a processing level of a processing tool, while fibers in a second portion of the bristle field area are not in contact with said processing level, said apparatus comprising a pushing element which impinges upon the fibers at their free ends for deflection of the fibers of the second portion of the field, and means for moving the pushing element and the brush relative to one another in the longitudinal direction of the bristle field area.

2. Apparatus according to claim 1, wherein the pushing element comprises an essentially U-shaped channel having a base and uprights which form lateral guides, the base at least partially covering the fiber ends to be deflected, and the lateral guides preventing lateral straying of fibers away from the second portion to be deflected.

3. Apparatus according to claim 1, comprising at least two processing stations having at least one common pushing element for the fibers to be deflected, which remains in constant contact with the bristle field, while the brush is located within one of the processing stations or in between them.

4. Apparatus according to claim 3, wherein several pushing elements are connected to each other.

5. Apparatus according to claim 4, wherein the pushing elements are arranged in a symmetrical manner.

6. Apparatus according to claim 3, wherein the pushing elements are arranged in a fixed manner in relation to the processing stations and the brush is movable in relation to pushing elements.

7. Apparatus according to claim 3, comprising at least one additional processing station, in which the distance between the processing level and the bristle field is adjustable, said additional processing station having at least one pushing element that can be moved with respect to the brush.

8. Apparatus according to claim 1, further comprising means for changing the orientation of the brush in relation to the pushing element.

* * * * *